US008263848B2

(12) United States Patent
Aspland

(10) Patent No.: US 8,263,848 B2
(45) Date of Patent: Sep. 11, 2012

(54) DRUM

(76) Inventor: Mark Aspland, Berwick (AU)

( * ) Notice: Subject to any disclaimer, the term of this patent is extended or adjusted under 35 U.S.C. 154(b) by 0 days.

(21) Appl. No.: 12/614,790

(22) Filed: Nov. 9, 2009

(65) Prior Publication Data

US 2010/0050852 A1 Mar. 4, 2010

Related U.S. Application Data

(63) Continuation of application No. 10/568,358, filed as application No. PCT/AU2005/000757 on May 27, 2005, now Pat. No. 7,692,083.

(30) Foreign Application Priority Data

May 27, 2004 (AU) ..... 2004902819

(51) Int. Cl.
*G10D 13/02* (2006.01)

(52) U.S. Cl. ..... 84/415; 84/411 R

(58) Field of Classification Search ..... 84/415, 84/411 R, 402, 404, 422.1, 422.2, 422.3, 84/420

See application file for complete search history.

(56) References Cited

U.S. PATENT DOCUMENTS

| | | | | | |
|---|---|---|---|---|---|
| 1,601,721 | A | * | 10/1926 | Colledanchise | 446/420 |
| 2,132,211 | A | * | 10/1938 | Hueckstead | 84/422.1 |
| 2,313,313 | A | * | 3/1943 | Bascom | 84/404 |
| 2,495,495 | A | * | 1/1950 | Adler | 84/411 R |
| 2,986,400 | A | * | 5/1961 | Phillips | 280/7.17 |
| 3,326,074 | A | * | 6/1967 | Osty et al. | 84/411 R |
| 4,248,009 | A | * | 2/1981 | Ferris et al. | 446/409 |
| 4,758,197 | A | * | 7/1988 | Lee | 446/213 |

* cited by examiner

*Primary Examiner* — Jianchun Qin
(74) *Attorney, Agent, or Firm* — Edwin D. Schindler

(57) ABSTRACT

A drum having a resonant chamber for producing a range of sounds and at least one device for allowing the sound so produced to be altered, which includes a plurality of internal snares which can be brought into contact with the internal surface of the external surface of the resonant chamber which is struck by the player. The drum may also include a bass drum stick mounted within the chamber and adapted for movement to be able to selectively strike the inner surface of the drum which is struck by the player. The bass drum stick may include a pedal, or other device, operable by the player and external to the drum for effecting movement of the bass drum stick.

20 Claims, 4 Drawing Sheets

15

15'

DRUM

CROSS-REFERENCE TO PRIOR APPLICATION

This is a continuation of application Ser. No. 10/568,358, filed Apr, 26, 2007, which represents the U.S. National Phase application of P.C.T. Application No. PCT/AU2005/000757, filed May 27, 2005, now U.S. Pat. No. 7,692,083.

TECHNICAL AREA

This invention relates to the area of musical instruments and in particular, to an improved drum unit which is adapted to enable a user to produce a. range of sounds, and can be used alone or to compliment other instruments.

In particular, the drum is of a type generally known as a Cajon or box drum which makes use of the fact that a hollow solid rectangle or tube provides an effective reverberation chamber and this knowledge has been used for many years to make instruments such as drums and "tea-chest" basses. Where drums are made they can be provided of a size sufficient to provide a seat and at least one surface is of a material which can vibrate to provide a required sound.

BACKGROUND TO THE INVENTION

Drums of this kind have become a popular instrument, now commonly used in Flamenco and Cuban music, which is made to produce particular sounds suited to a particular style of music. Initially, different drums had to be produced for each style of music due to the diverse sounds associated with each style of music.

In order to overcome the need for separate drums, a combination drum was produced which enabled a user to alternate between different styles sounds via a switch or lever. Thus, a user could utilise the same drum to play both Flamenco and Cuban styled music, as well as folk, jazz and other music.

OUTLINE OF THE INVENTION

It is an object of the present invention to provide an improved drum which not only produces more than one style of sound, but also enables to the user to alter the range and frequency of the sounds and produce sounds of other instruments which are often used in accompaniment with a drum depending on the particular style of music.

The invention provides an improved drum having a resonant chamber which is adapted to produce a range of sounds and at least one means whereby the sound produced is able to be altered or changed.

It is preferred that the first means be a plurality of internal snares which can be brought into contact with the internal surface of the unit which is struck by the player to alter the type of sound produced.

It is preferred that a second means may be by the provision of a bass drum stick mounted within the chamber and adapted for movement to be able to selectively strike the inner surface of the drum which is struck by the player, the means to effect movement of the stick being external to the drum and operable by the player.

DESCRIPTION OF AN EMBODIMENT OF THE INVENTION

In order that the invention may be more readily understand we will describe byway of non-limiting example, and in relation to the following drawings, one specific embodiment thereof.

Figure 1:
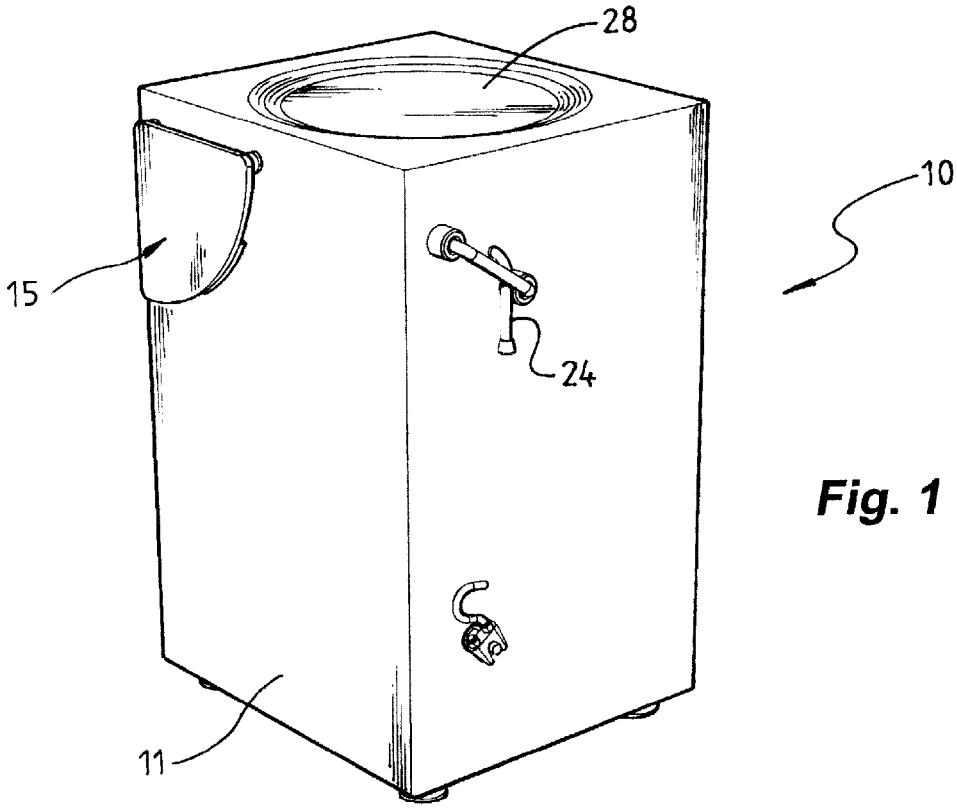
FIG. 1 is a perspective view of the front of the drum of the invention.
Figure 2:
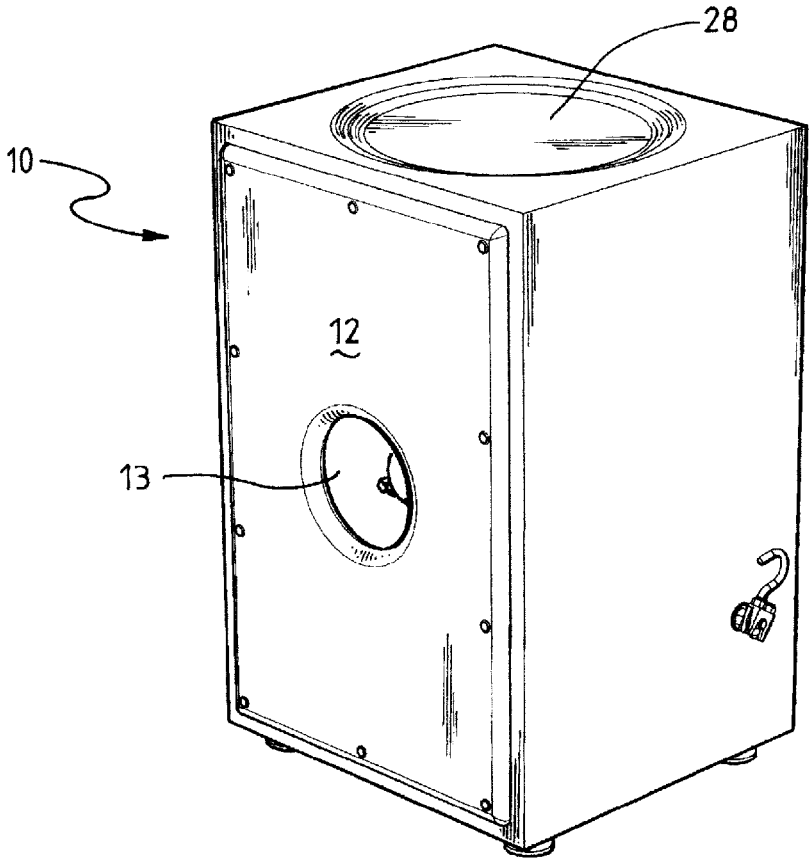
FIG. 2 is a rear view of the drum of FIG. 1.
Figure 3:
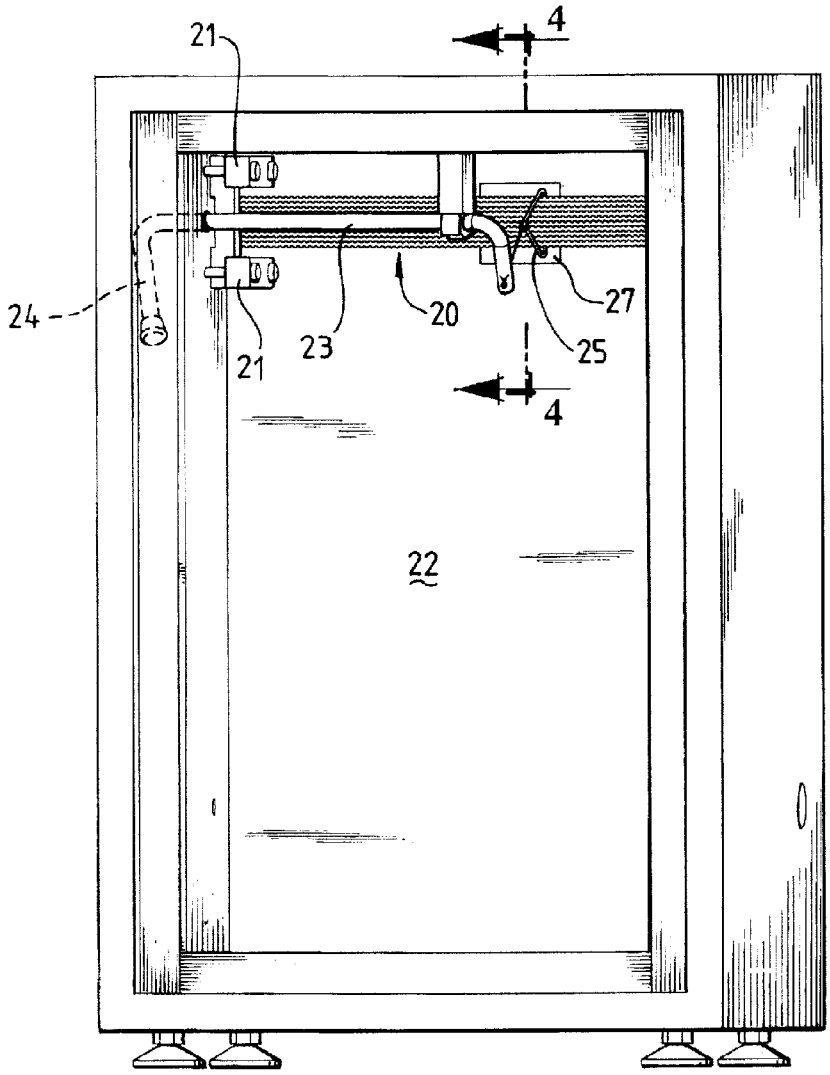
FIG. 3 is a rear elevation from the back of the drum showing the snares.

In this embodiment, the drum unit 10 is box-shaped with a central aperture 13 provided on a back face 12, or side face of the unit.

In the embodiment, the unit is largely made of a wood or some other material having the required strength, whilst the front face 11 is preferably made of a plywood specifically selected for its make-up and strength and subsequently, the sound that it will produce. However, the face and/or the entire unit could also be made from any other suitable material such as aluminium, sheet metal, or synthetic materials depending on the sound you wish to achieve.

The inside of the drum unit is hollow and functions as a resonant cavity for the unit. The resonant cavity is a natural amplifier for any sound which the drum unit emits.

Provided on the inside of the drum unit are a plurality of snare wires 20. In a preferred arrangement, the snare wires are evenly spaced apart from each other and are attached to the inside of either side of the box and may be clamped in position by blocks 21.

Figure 4:
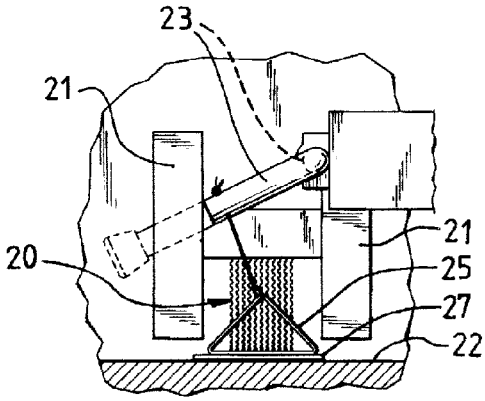
FIG. 4 is a view along line 4-4, showing the snares abutting the internal surface of the drum.
Figure 5:
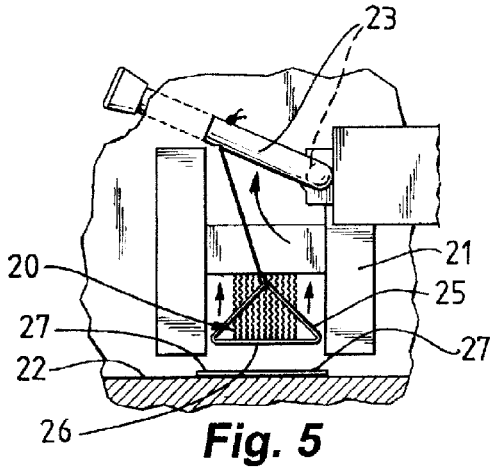
FIG. 5 is a view similar to FIG. 4 showing the snares spaced therefrom.

In a first position, illustrated in FIG. 5, the snare wires are held such that they are spaced apart from the inner front surface 22 of the unit so that they cannot interfere with the sound produced from the drum. In a second position illustrated in FIG. 4, the snare wires are brought into and are held in contact with the inner front surface of the unit such that, when the drum is struck, the snare wires interfere with the normal reverberation to produce a different sound.

Movement of the snares between a first and second position is controlled via a shaft mechanism 23 that is operated by a lever arm 24 or the like positioned on one of the outer side surfaces. The shaft mechanism may involve a rotatable shaft member 23 which can be located above the snare wires. The shaft is in connection with the lever 24. Thus, turning of the lever cause the rotation of the shaft member. This rotation may be achieved directly, as illustrated, or by a gear or the like to which the shaft member may be connected. Attached to the shaft can also be a saddle member, which may be made of wire and which has a central portion 26 which is located beneath the snare wires 20 is adapted to pick-up and move the snare wires as the shaft is rotated backwards or forwards.

Provided on the inner front surface of the drum unit there may be a magnet so that when the lever is turned and the wires are brought into close proximity to the magnet, the magnet will attract and hold the wires in place to produce the required sound as the drum face is struck. Alternatively, if the orientation of the components are correct, the snares will move into contact with the inner front surface.

These positions can clearly be seen from FIGS. 4 and 5.

Also mounted in the box there is a bass drum stick 30 which comprises a head 31 and a shaft 32, the shaft being connected to a rotatable shaft 33 which extends across and through the walls on either side of the box and which has at its outer ends connector means 35 to which a drum pedal connection can be made.

The drum stick is normally held in an upright position by a flexible extendable member 34 which can be connected between the shaft 33 and the side wall of the box.

Figure 6:
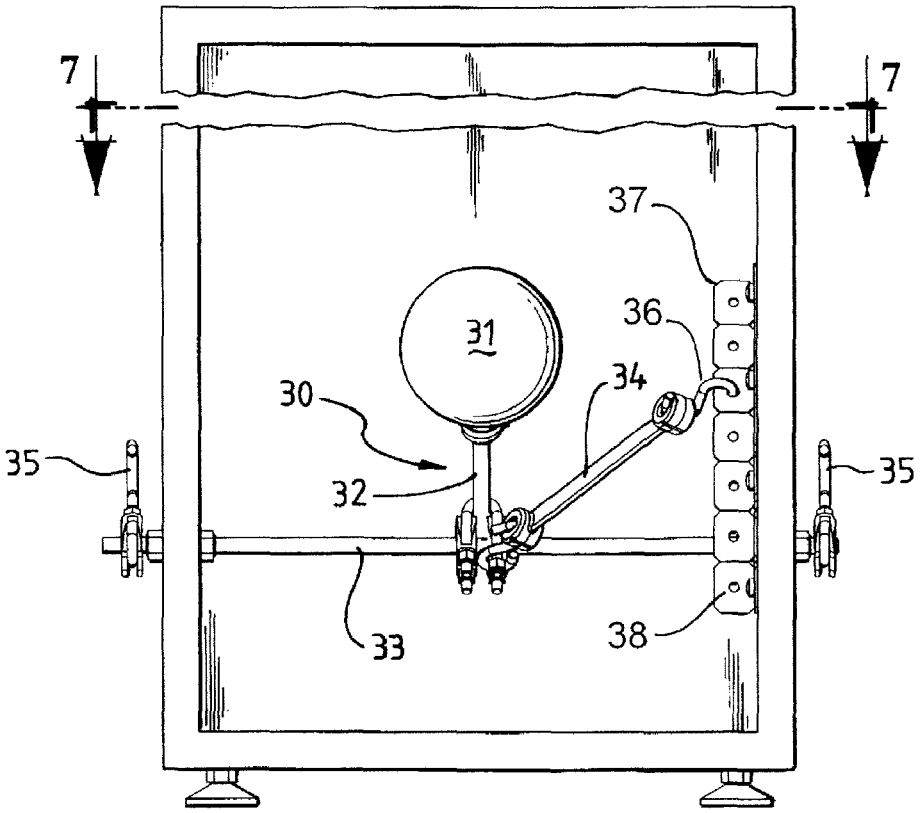
FIG. 6 is a further rear elevation of the drum with a bass drum stick located therein.
Figure 7:
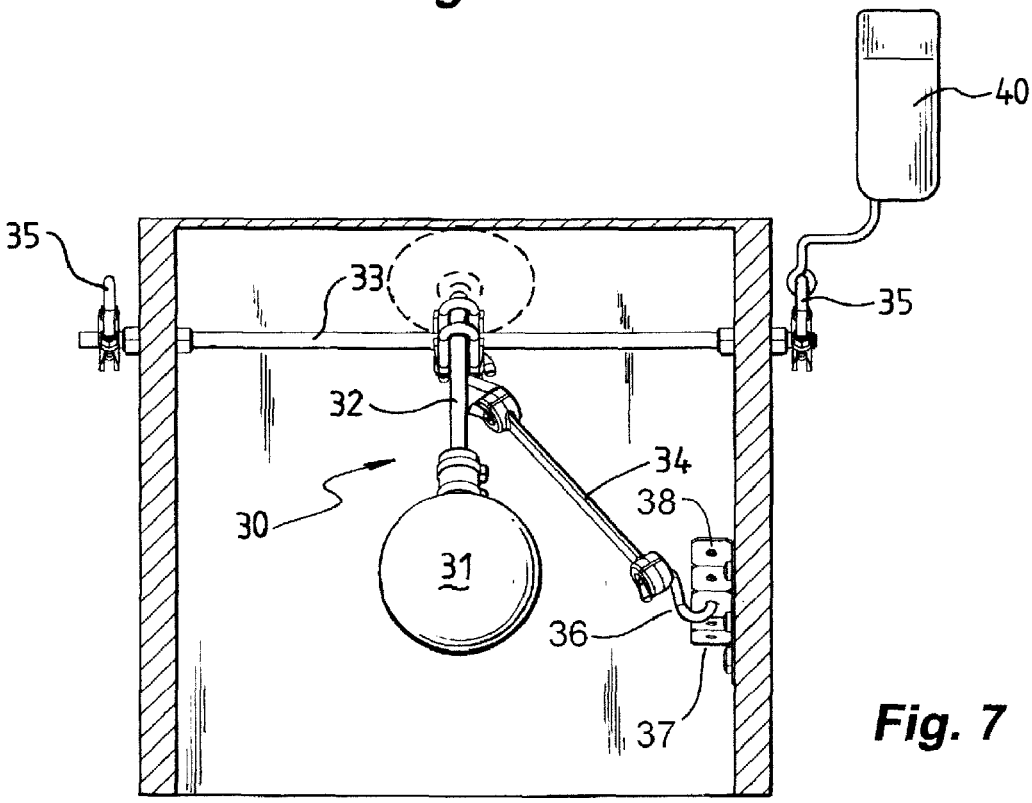
FIG. 7 is a view along line 7-7 of FIG. 6.

In FIGS. 6 and 7, the flexible extendable member 34 is shown as having means for connecting to a mounting bracket 37 located along a side wall of the drum. The means for connecting may, for example, be a hook 36 as shown in FIGS. 6 and 7. The mounting bracket 37 may be provided with a plurality of holes 38 for locating the hook 36 of the flexible extendable member 34 at a plurality of positions along the mounting bracket 37. The mounting bracket 37, which, when connected to the flexible extendable member 34, provides the anchorage for the return energy for repositioning the head 31 of the drum stick 30.

In use a foot pedal 40 can be connected to the member 35 so that when the foot pedal is depressed the stick 30 moves from the position shown in solid line in FIG. 7 to the position shown in dashed line where is contacts the front surface 11 of the drum.

As will be understood, the drum plays different notes, depending upon where on the face it is hit. In general terms, the nearer the edge of the face 11 the drum is hit, the higher pitched the note, and the closer to the centre of the drum, the notes are substantially lower.

As the drumstick 30 is required to provide a bass note, the head of the stick is arranged so that when it strikes the face 11, it strikes it substantially centrally so as to provide the bass note.

Because of the different notes at different positions, when a player is playing the drum, he or she will normally vary the position at which they strike the face to give required different notes.

An extension 13 may be provided which is adapted to be attached to the aperture 13 provided on the drum unit. In a preferred embodiment, the extension may be a "boom-tube" which is adapted to be secured over the central aperture provided on the back face of the unit. The extension may have provided at least one clip which is adapted to connect and secure the extension to the wall of the central aperture. The extension may also have provided a seal around the perimeter of the edge of the tube which attaches to the aperture to ensure no sound is lost, and all sound goes through the tube.

The function of the "boom-tube" is to enhance the bass notes by altering the frequency of the notes that are produced by the unit. The frequency is altered by dropping the notes down by at least one octave to produce a warm acoustic sound.

The drum unit of the invention may also include attachable sound effect boards, examples of which are shown in FIGS. 8 and 9 and FIGS. 10 and 11 which can be removably attached to the unit to provide a range of alternate sounds different to those which would otherwise be obtained from the drum. These could be equivalent to the sound from instruments which are normally used in accompaniment with a drum set. Provided on the front surface 11 of the drum can be at least one attachment means which is adapted to receive and hold the attachable sound effect boards in place. The attachment means may be in the form of Velcro™ tabs, or in a preferred embodiment, a means of attachment which does not produce a noise upon disconnection such as magnets. In this way, a microphone will not be able to detect any background noise that may arise when a user is placing or replacing the sound effect boards onto the unit. It is envisaged that some of the sounds that may be provided on these boards are "crack", triangle, tambourine, "snare", "cabasa", "cymbal", "finger cymbal", "shaker", "castanet", "guiro" and "afuche" sounds. However, this sounds which may be used are not intended to be restricted to the list provided herein.

Figure 8:
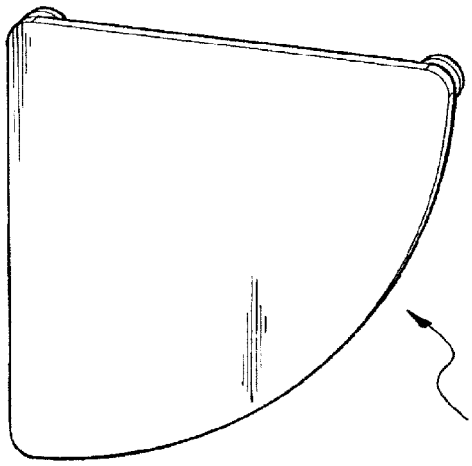
FIG. 8 is the appearance of an accessory board for attachment or when attached to the drum.
Figure 9:
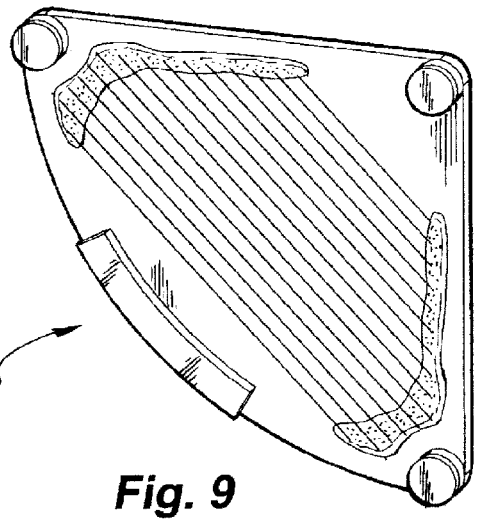
FIG. 9 is an underneath view of the board of FIG. 8.
Figure 10:
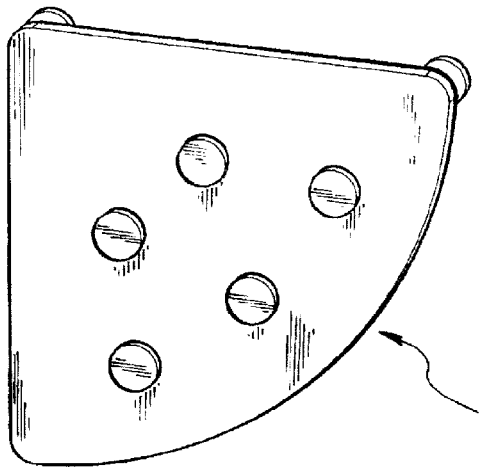
FIG. 10 is a front view of a further form of accessory board.
Figure 11:
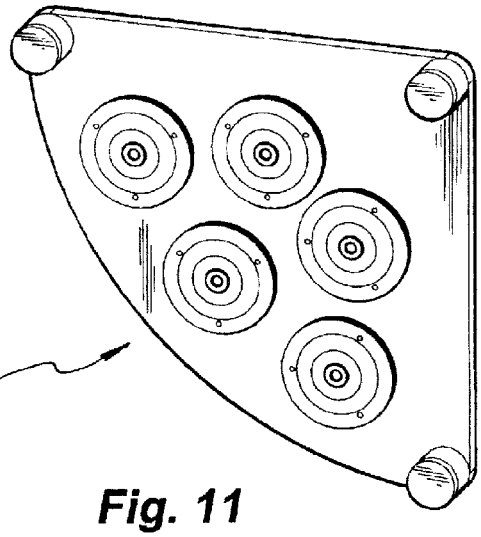
FIG. 11 is an underneath view of the board of FIG. 10.

The sound effect board of FIGS. 8 and 9 provide a snare sound and the one shown in FIGS. 10 and 11 tambourine jingles.

The unit, when provided with a bass drum stick, and its operating pedal, is able to be used as a "stomp box" for a guitarist or the like to enable the user to provide a required beat or pulse.

In practice the player sits on the top face 28 of the drum positioning their legs about the sides of the drum. To play the drum the player simply strikes the front face 11 to a predetermined rhythm and depending upon where the face is struck, the frequency of the note varies. Also, if required to alter the tone or frequency further, the user can fix the "bass-tube" extension onto the back of the drum which appears to drop the bass notes down an octave but may actually attenuate the higher frequency notes so there is an impression of change in the bass notes.

In order to achieve the sounds of other instruments in combination with the drum beat, the user can simply attach a particular attachable sound effects board to the front face and strike the sounds effects board intermittently/periodically to achieve the desired effect.

At the same time the player can have one foot on a pedal attached to the drum stick and by moving his or her foot upwardly and downwardly so a drum beat can be provided and this is normally of the deepest frequency of the device because of the location of the head of the stick when it strikes the face.

While I have described herein particular embodiments of the drum unit it should be noted that the same principle could be applied to a tea chest bass or any other similar construction. It is also envisaged that all embodiments of the drum unit may be made such that the unit is able to be folded for easy storage and transportation.

It is further envisaged that other embodiments of the invention could exhibit variations in the features described. It is however envisaged that other embodiments of the invention will exhibit any number of and combination of the features previously described and it is to be understood that variations and modifications in this can be made without departing from the spirit and scope thereof.

I claim:

1. A percussion assembly including a sound box having upright walls, a seat top, and an interior, the assembly comprising:

a) a beater located in the box interior, and b) means to activate the beater to repeatedly beat against a surface of a wall against which the beater strikes at said interior, said means including a rotary shaft outside the box and extending toward a box wall, and operatively connected to the beater in the box, the beater being normally held in an upright position via a flexible extendable member connected between the rotary shaft and a mounting bracket located on an interior side of a side wall of the sound box.

2. The assembly of claim 1, wherein said wall against which the beater strikes has different outer surface portions located to be selectively manually impacted.

3. The assembly of claim 1, including a foot operated pedal operatively connected to the rotary shaft to effect reciprocating rotary shaft movement.

4. The assembly of claim 1, wherein said means include a foot operated pedal operatively connected to said rotary shaft outside the box to effect reciprocating rotary shaft movement.

5. The assembly of claim 1, wherein said box wall defines an opening via which rotary movement is transmitted by the rotary shaft.

6. The assembly of claim 1, wherein said wall surface is separate from a box wall toward which the beater is displaced.

7. A method of producing rhythm, that includes providing the assembly of claim 1, and i) activating the beater as defined in b) of claim 1, ii) and manually striking a box wall surface, rhythmically in relation to said step i).

8. The assembly of claim 1, wherein the flexible extendable member connected between the rotary shaft and the mounting bracket is able to be connected at a plurality of points along the mounting bracket.

9. A percussion assembly including a sound box having upright walls, a seat top, and an interior, the assembly comprising:

a) a beater located proximate one of said walls, b) means to activate the beater to repeatedly beat against a surface of said one wall, said means including a rotary shaft outside the box and extending toward said one box wall, and operatively connected to the beater, the beater being normally held in an upright position via a flexible extendable member connected between the rotary shaft and a mounting bracket located on an interior side of a side wall of the sound box, and c) a foot operated pedal operatively connected to the rotary shaft to effect reciprocating rotary shaft movement.

10. The assembly of claim 9, wherein the flexible extendable member connected between the rotary shaft and the mounting bracket is able to be connected at a plurality of points along the mounting bracket.

11. A percussion assembly including a sound box having upright walls, a seat top, and an interior, the assembly comprising:

a) a beater located in the box interior, and b) means to activate the beater to repeatedly beat against a surface against which the beater strikes of a wall at said interior, said means including a shaft mechanism outside the box and extending toward a box wall, and operatively connected to the beater in the box, the beater being normally held in an upright position via a flexible extendable member connected between the shaft mechanism and a mounting bracket located on an interior side of a side wall of the sound box.

12. The assembly of claim 11, wherein said wall against which the beater strikes has different outer surface portions located to be selectively manually impacted.

13. The assembly of claim 11, including a foot operated pedal operatively connected to the shaft mechanism to effect reciprocating shaft movement.

14. The assembly of claim 11, wherein said means include a foot operated pedal operatively connected to said shaft mechanism outside the box to effect reciprocating shaft mechanism movement.

15. The assembly of claim 11, wherein said box wall defines an opening via which movement is transmitted by the shaft mechanism.

16. The assembly of claim 11, wherein said wall surface is separate from a box wall toward which the beater is displaced.

17. A method of producing rhythm, that includes providing the assembly of claim 11, and i) activating the beater as defined in b) of claim 11, ii) and manually striking a box wall surface, rhythmically in relation to said step i).

18. The assembly of claim 11, wherein the flexible extendable member connected between the shaft mechanism and the mounting bracket is able to be connected at a plurality of points along the mounting bracket.

19. A percussion assembly including a sound box having upright walls, a seat top, and an interior, the assembly comprising:

a) a beater located proximate one of said walls, b) means to activate the beater to repeatedly beat against a surface of said one wall, said means including a shaft mechanism outside the box and extending toward said one box wall, and operatively connected to the beater, the beater being normally held in an upright position via a flexible extendable member connected between the shaft mechanism and a mounting bracket located on an interior side of a side wall of the sound box, and a foot operated pedal operatively connected to the shaft mechanism to effect reciprocating shaft movement.

20. The assembly of claim 19, wherein the flexible extendable member connected between the shaft mechanism and the mounting bracket is able to be connected at a plurality of points along the mounting bracket.

* * * * *